US011532226B2

(12) United States Patent
Pirkle et al.

(10) Patent No.: US 11,532,226 B2
(45) Date of Patent: Dec. 20, 2022

(54) SYSTEM AND METHOD FOR ACOUSTICALLY IDENTIFYING GUNSHOTS FIRED INDOORS

(71) Applicant: Tyco Fire & Security GmbH, Neuhausen am Rheinfall (CH)

(72) Inventors: Wesley C. Pirkle, New Albany, OH (US); Richard L. Shoaf, Westerville, OH (US)

(73) Assignee: Tyco Fire & Security GMBH, Neuhausen am Rheinfall (CH)

( * ) Notice: Subject to any disclaimer, the term of this patent is extended or adjusted under 35 U.S.C. 154(b) by 0 days.

(21) Appl. No.: 17/060,390

(22) Filed: Oct. 1, 2020

(65) Prior Publication Data

US 2021/0020023 A1 Jan. 21, 2021

Related U.S. Application Data

(63) Continuation of application No. 16/328,070, filed as application No. PCT/US2017/046940 on Aug. 15, 2017, now Pat. No. 10,832,565.

(Continued)

(51) Int. Cl.

| | |
|---|---|
| ***G08B 29/18*** | (2006.01) |
| ***G08B 13/16*** | (2006.01) |
| ***G08B 17/08*** | (2006.01) |
| ***G10L 25/51*** | (2013.01) |
| ***H04R 1/40*** | (2006.01) |
| ***H04R 3/00*** | (2006.01) |

(52) U.S. Cl.

CPC ..... *G08B 29/185* (2013.01); *G08B 13/1672* (2013.01); *G08B 17/08* (2013.01); *G10L 25/51* (2013.01); *H04R 1/406* (2013.01); *H04R 3/005* (2013.01)

(58) Field of Classification Search

CPC .. G08B 29/185; G08B 13/1672; G08B 17/08; G10L 25/51; H04R 1/406; H04R 3/005

See application file for complete search history.

(56) References Cited

U.S. PATENT DOCUMENTS 2,837,730 A * 6/1958 Snyder ..... G01S 3/84 367/129
3,940,575 A * 2/1976 Bauer ..... H04R 1/38 381/177

(Continued)

OTHER PUBLICATIONS

International Search Report and Written Opinion, dated Nov. 7, 2017, from International Application No. PCT/US2017/046940, filed on Aug.15, 2017. 15 pages.

(Continued)

*Primary Examiner* — Chico A Foxx
(74) *Attorney, Agent, or Firm* — HoustonHogle LLP

(57) ABSTRACT

A system and method for acoustically detecting the firing of gunshots indoors employs multiple microphones (15, 20) which are utilized individually and in combination to detect sounds inside a building or other structure and, upon sensing a loud impulsive sound which is indicative of a gunshot, processing signals from both microphones (15, 20) to determine if the sound is that of a gunshot. The system and method relies on the acoustic signature of the noise as collected, with the acoustic signature being analyzed to arrive at values which are then compared to adjustable levels that signify a gunshot.

20 Claims, 2 Drawing Sheets

Related U.S. Application Data

(60) Provisional application No. 62/380,701, filed on Aug. 29, 2016.

(56) References Cited

U.S. PATENT DOCUMENTS 4,091,366 A 5/1978 Lavallee
4,279,027 A 7/1981 Van Sloun
5,237,512 A 8/1993 Davidson
5,455,868 A 10/1995 Sergent et al.
5,504,717 A 4/1996 Sharkey et al.
5,917,775 A 6/1999 Salisbury
5,978,490 A * 11/1999 Choi ..... H04R 3/005 381/92
6,185,153 B1 2/2001 Hynes et al.
6,538,570 B1 3/2003 Smith
8,335,320 B2 * 12/2012 Abe ..... G10K 11/17873 381/71.6
8,421,015 B1 4/2013 Scott et al.
9,830,932 B1 11/2017 Gunderson et al.
10,210,726 B2 2/2019 Carter et al.
2003/0021188 A1 1/2003 Baranek et al.
2003/0055655 A1 * 3/2003 Suominen ..... G06F 3/167 704/276
2004/0161120 A1 8/2004 Petersen et al.
2006/0256660 A1 11/2006 Berger
2008/0175399 A1 * 7/2008 Kim ..... H04R 3/005 381/57
2008/0204757 A1 * 8/2008 Manning ..... G01J 3/02 356/451
2009/0059724 A1 3/2009 Scanlon
2009/0180628 A1 7/2009 Stephanson
2009/0253468 A1 * 10/2009 Oberstelehn ..... H04M 1/72448 455/570
2010/0329481 A1 * 12/2010 Fukuda ..... H04R 1/1083 381/94.1
2011/0218952 A1 9/2011 Mitchell
2011/0246402 A1 10/2011 Burman
2012/0300587 A1 11/2012 Azimi-Sadjadi et al.
2013/0202120 A1 * 8/2013 Bickel ..... G08B 13/1672 381/56
2014/0327543 A1 11/2014 Showen et al.
2014/0361886 A1 12/2014 Cowdry
2015/0070166 A1 3/2015 Boyden et al.
2015/0071450 A1 3/2015 Boyden et al.
2015/0106095 A1 4/2015 Mitchell
2015/0131411 A1 5/2015 Gudgel et al.
2015/0263688 A1 * 9/2015 Nicolino, Jr. ..... H04R 1/1041 381/57
2015/0347079 A1 12/2015 Price et al.
2015/0364028 A1 12/2015 Child et al.
2016/0078883 A1 * 3/2016 Oami ..... G10L 25/57 704/270
2016/0157032 A1 6/2016 Kane et al.
2016/0163168 A1 * 6/2016 Brav ..... G08B 21/043 381/56
2016/0209390 A1 7/2016 Overcast
2016/0232774 A1 8/2016 Noland et al.
2016/0260307 A1 9/2016 Skorpik et al.
2016/0334500 A1 11/2016 Damarla
2017/0103776 A1 4/2017 Kim et al.
2017/0108374 A1 4/2017 Coleman et al.
2017/0123038 A1 5/2017 Griggs et al.
2017/0169686 A1 6/2017 Skorpik et al.
2018/0293858 A1 10/2018 Carter et al.
2019/0212186 A1 * 7/2019 Warren ..... H04R 29/00
2019/0347920 A1 11/2019 Anderson et al.
2019/0371160 A1 12/2019 Pace

OTHER PUBLICATIONS

Tolonen, T., et al., "A Computationally Efficient Multipitch Analysis Model," IEEE Transactions on Speech and Audio Processing, 8(6): 708-716 (2000).
International Preliminary Report on Patentability, dated Mar. 14, 2019, from International Application No. PCT/US2017/046940, filed on Aug. 15, 2017. 9 pages.

* cited by examiner

SYSTEM AND METHOD FOR ACOUSTICALLY IDENTIFYING GUNSHOTS FIRED INDOORS

RELATED APPLICATIONS

This application is a Continuation of U.S. patent application Ser. No. 16/328,070, filed on Feb. 25, 2019, which is a § 371 National Phase Application of International Application No. PCT/US2017/046940, filed on Aug. 15, 2017, now International Publication No. WO 2018/044553, published on Mar. 8, 2018, which International Application claims the benefit under 35 USC 119(e) of U.S. Provisional Application No. 62/380,701, filed on Aug. 29, 2016, all of which are incorporated herein by reference in their entirety.

FIELD OF THE INVENTION

The present invention pertains to the art of acoustics and, more particularly, to a system and method employing acoustics in connection with identifying the firing of gunshots indoors.

DISCUSSION OF THE PRIOR ART

The broad concept of detecting gunshots utilizing acoustics is known. More specifically, it is known to provide a gunshot detecting system including an array of acoustic sensors positioned in a pattern which enables signals from the sensors to be employed to not only detect the firing of a gunshot but to also locate the origin of the shot. One main requirement of such a system is the need to accurately distinguish between the sound produced from a gunshot and a host of other ambient sounds. In at least one known arrangement, a microphone is used to detect each sound, which is then amplified, converted to an electrical signal and then the electrical signal is compared with a threshold value above which a gunshot sound is expected to exceed.

Regardless of the known arrangements in this field, there is still seen to exist a need for a system and method for acoustically detecting the firing of gunshots indoors which represents an improvement in terms of at least one or more of accuracy, dependability and effectiveness, particularly an acoustic gunshot detection system and method which provides for very low false alarms or false positives while, at the same time, provides for high detection rates.

SUMMARY OF THE INVENTION

The present invention is directed to a system and method for acoustically detecting the firing of gunshots indoors wherein multiple microphones are utilized individually and in combination to detect sounds inside a building or other structure and, upon sensing a loud impulsive sound, processing is performed to determine if the sound is that of a gunshot. The system and method relies on the acoustic signature of the noise as collected, with the acoustic signature being analyzed to arrive at values which are then compared to adjustable levels that signify a gunshot. If it is determined that a gun has been fired, the system can issue alerts, including notifying emergency personnel.

In a particular embodiment, two MEMs microphones (microelectromechanical microphones) having different sensitivity levels are employed for each sensor. The microphones are omnidirectional, with one microphone having a low sensitivity and a high clipping level, while the other microphone is more sensitive. Within the overall sensor, the two microphones are arranged orthogonal to each other. The sensor preferably includes a single board computer which is configured to sample the multiple MEMs microphones, such that the outputs from the microphones can be continuously analyzed in near real time for a gunshot signature. The sensor is electrically powered and networkable, thereby enabling output signals to be transferred remotely, either for additional processing or other purposes such as alerting emergency personnel of a shooting at a specific location in a particular building.

In accordance with a preferred embodiment of operation, the initial gunshot identification is accomplished by analyzing incoming acoustic signals from the lower sensitivity microphone, particularly by searching the incoming acoustic signal for a peak amplitude level large enough to be at least preliminarily identified as a gunshot. Once an indication of a possible gunshot has been triggered utilizing the lower sensitivity microphone, the sensed impulsive sound is processed. In particular, a series of calculations are performed, with the results of these calculations are compared with established threshold values and, if the comparisons are positive, a gunshot verification is established. Upon gunshot verification, a threat message is preferably produced which can be sent from the sensor to another computer used to alert emergency personnel. The threshold levels can be selectively adjusted and set based on the acoustics of the building or other structure, as well as the sensor layout employed.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
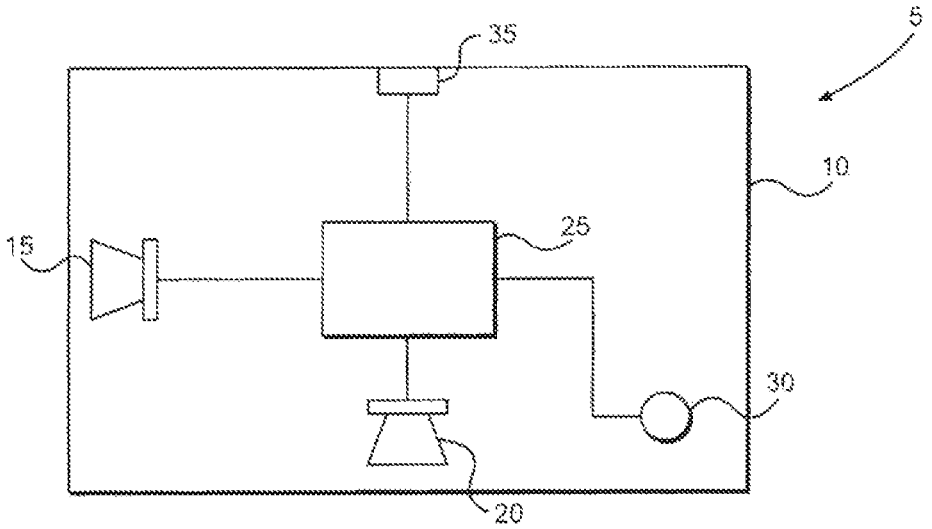
FIG. 1 schematically indicates structure associated with the sensor of the invention.

With initial reference to FIG. 1, a gunshot detection sensor designed for mounting within a building or structure to be monitored for gunshots in accordance with the invention is generally indicated at 5. In the embodiment shown, sensor 5 includes a single computer board 10 linked to a first microphone 15 and a second microphone 20. As depicted, first and second microphones 15 and 20 are preferably arranged orthogonal to each other and connected to a CPU 25 (particularly a multi-core processor for fast signal processing) which is electrically powered, such as through a 5V battery 30, a micro USB port or the like. Also provided as part of sensor 5 is a network connector, such as an Ethernet, USB or the like connection port indicated at 35. At this point, it should be noted that sensor 5 can actually take on various forms while functioning and operating in the manner which will be detailed below. Certainly, it should be recognized that sensor 5 could be electrically powered in various ways, including being electrically hardwired, and need not be network hardwired but rather can incorporate a wireless interface. In general, it is important that CPU 25 is capable of sampling acoustic signals received from both microphones 15 and 20, specifically at a minimum of 192 KHz.

In the most preferred form of the invention, each microphone 15, 20 constitutes a MEMs microphone which is omnidirectional. In accordance with the invention, one microphone 15 has a low sensitivity while the other microphone 20 is more sensitive. In accordance with the invention, a low sensitivity is defined as below −40 dBFS while, by "more sensitive" it is meant that microphone 20 has a sensitivity which is at least 70% greater than the sensitivity of the "low sensitivity" microphone 15. In an exemplary embodiment, microphone 15 has a low sensitivity of −46 dBFS, but with a high clipping level, specifically greater than 130 dB. On the other hand, microphone 20 has a sensitivity of −26 dBFS. Although various known microphones could be employed in connection with the invention, in one specific embodiment, currently available MEMs microphone models INMP621ACEZ-R7 and MP34DBO1TR which are digital, 16 bit microphones manufactured by InvenSense, Inc. are utilized for the first and second microphones 15 and 20 respectively.

In general, the system and method operates by initially identifying an incoming acoustic signal which could potentially be from a gunshot. For this purpose, only outputs from microphone 15 are initially, continuously analyzed for a peak amplitude level large enough to be preliminarily identified as a gunshot. Basically, since microphone 15 has a low sensitivity, microphone 15 only provides an output for very loud sounds and is essentially deaf to normal, everyday sounds emanating from within the building or structure and therefore will likely not reach a necessary threshold on any noise other than the loudest sounds. By way of example, a typical trigger value would be −5 dBFS (corresponding to a digital value of approximately 18000 based on the 16 bit unit). After a possible gunshot is identified in this manner, the system then processes acoustic signals to determine if the sound was actually from a gunshot in the manner detailed below.

Figure 2:
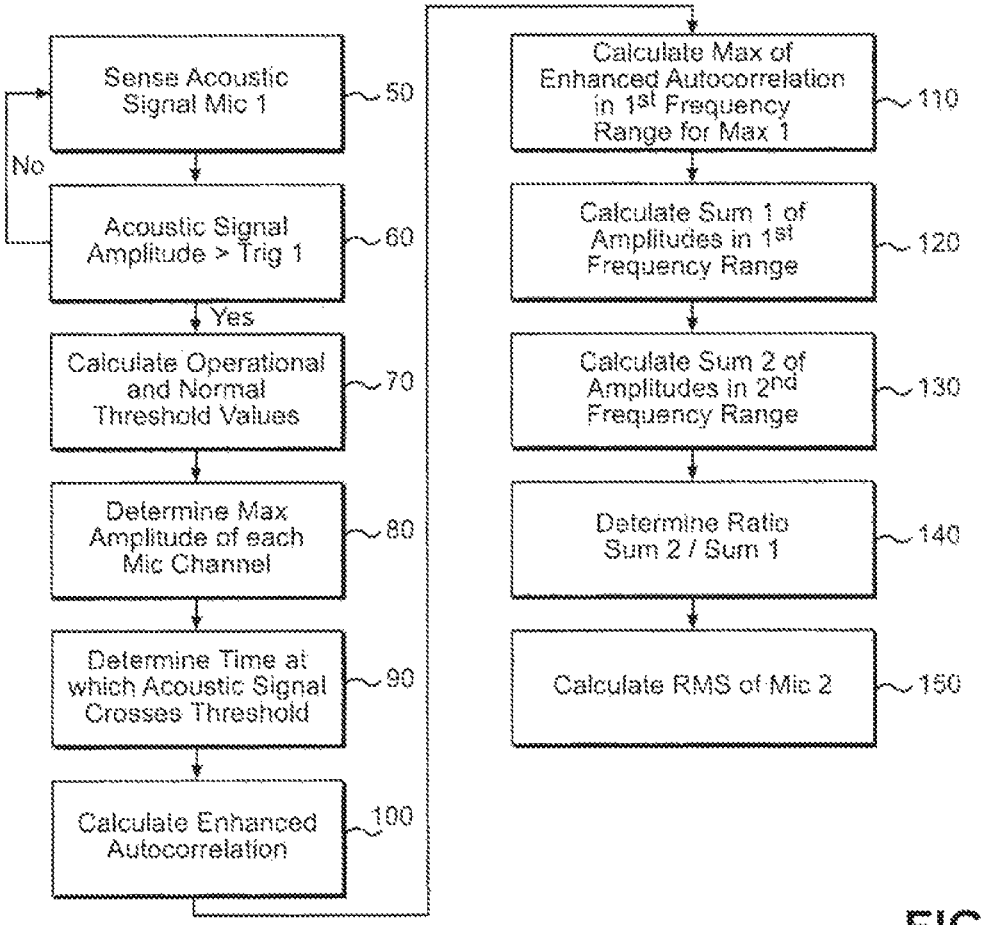
FIG. 2 is a flowchart of a calculation algorithm employed in accordance with the invention.

Reference will now be made to FIG. 2 in describing a preferred methodology employed in accordance with the invention. Here, it can be seen that steps 50 and 60 represent the initial possible gunshot identification routine outlined above which utilizes outputs from first microphone 15 and compares peak signal amplitudes with a pre-established trigger value, e.g., 18000. Assuming that a possible gunshot sound has been identified, step 70 is reached in which operational and nominal threshold values are established for upcoming calculations. At this point, it should be noted that these threshold values can actually be preset based on at least the acoustic characteristics of the particular building or structure in which sensor 5 is employed. However, for at least versatility reasons, it is desirable to enable these threshold values to be adjustable, such as based on changing acoustic characteristics or sensor layout. In addition to the trigger threshold, other established threshold values include: a Mic threshold (TH_1), a Mic2 RMS threshold (RMS_2_Thresh), a time window (Win_1), an enhanced autocorrelation window (EnAuto_Win_1), an enhanced autocorrelation threshold for an established frequency range between 15 kHz and 25 kHz (EnAuto_15_25_Thresh_1) and a maximum enhanced autocorrelation threshold for the established frequency range (EA_Max_15_25_TH). Byway of example, the following nominal threshold values can be employed: Trig_1=18000; TH_1=5000; RMS_2_Thresh=−13 dBFS (or an equivalent digital output of 7336); Win_1=0.30 seconds; EnAuto_Win_1=0.075 seconds; EnAuto_15_25_Thresh_1=1.25; and EA_Max_15_25_TH=325.

With these nominal threshold values being established, step 80 is entered wherein the maximum amplitude for each of microphones 15 and 20 is determined (Max_1 and Max_2). Next, the time at which the acoustic signal crosses the threshold is determined in step 90. Basically, there is a time lapse between first microphone 15 sensing the sound and outputting the signal which has been identified as a potential gunshot. Here, it is desired to determine time zero (T_Win_1) for the potential shot and use this time for future calculations. Although other formulations could be employed, for purposes of a preferred embodiment of the invention, T_Win_1 is set equal to the time at which the first microphone amplitude exceeds TH_1 minus a predetermined time period, preferably 10 ms, wherein T_Win_1 is required to be less than Win_1, i.e., 0.3 seconds, from the point at which the amplitude is greater than Trig_1. This same calculated time zero is also used in connection with second microphone 20 (T_Win_2=T_Win_1).

Next, step 100 is entered wherein an enhanced autocorrelation is calculated. At this point, it should be recognized that enhanced autocorrelation is known based on harmonics. Here, a known method is employed to filter data by determining pitches based on frequencies. As enhanced autocorrelation methods are known, further details will not be provided here. By way of example, reference is simply made to the article "A Computationally Efficient Multipitch Analysis Model" by Tolonen et al., IEEE Transactions on Speech and Audio Processing, Vol. 8, No. 6, (November 2000), the contents of which are fully incorporated herein by reference. With the invention, the preset operational enhanced correlation window (EnAuto_Win_1) is employed.

In step 110, a maximum value of the enhanced auto correlation is determined. For this purpose, values in a first frequency range or band between 15 kHz and 25 kHz are relied upon for microphone 15. Here, the process is looking to establish a peak in this frequency range (EA_Max_15_25_1). Next, all amplitudes in a slightly larger, second frequency range, preferably 10 kHz to 25 kHz, are summed in step 120 (EA_10_25_Sum_1). Thereafter, all amplitudes in a third, distinct frequency range, preferably frequency bands between 2 kHz to 5.5 kHz, are summed in step 130 (EA_2_55_Sum_1). These two summation steps in distinct ranges are performed in connection with avoiding a false positive identification based on knowing that sounds from a gunshot have a broad range as compared to many other potentially sensed sounds.

With all the above calculations, the algorithm moves to step 140 wherein a ratio of the summation values determined in steps 130 and 120 is determined, i.e., Ratio_EA_1=EA_2_55_Sum_1/EA_10_25_Sum_1. In this step, the denominator cannot equal zero. Therefore, if EA_10_25_Sum_1 equals zero, the Ratio_EA_1 is set to a predetermined value, such as 3.0. Finally, in step 150, the RMS of microphone 20 is calculated. More specifically, the RMS of microphone 20 (RMS_Full_2) is calculated using Win_1 and starting at T_Win_2. Basically, these steps are performed to see how the sound dissipates over a relatively short period of time, say 0.3 seconds, for microphone 20. Here it should be noted that the sound associated with a gunshot takes a fair amount of time to dissipate versus, say, tapping a microphone. Therefore, it can be verified here that the RMS stays high for a requisite period of time. Additionally, it should be recognized that signals from microphone 20 can be used for further verification, e.g., sensing sounds of screaming versus laughter or minor chatter.

Figure 3:
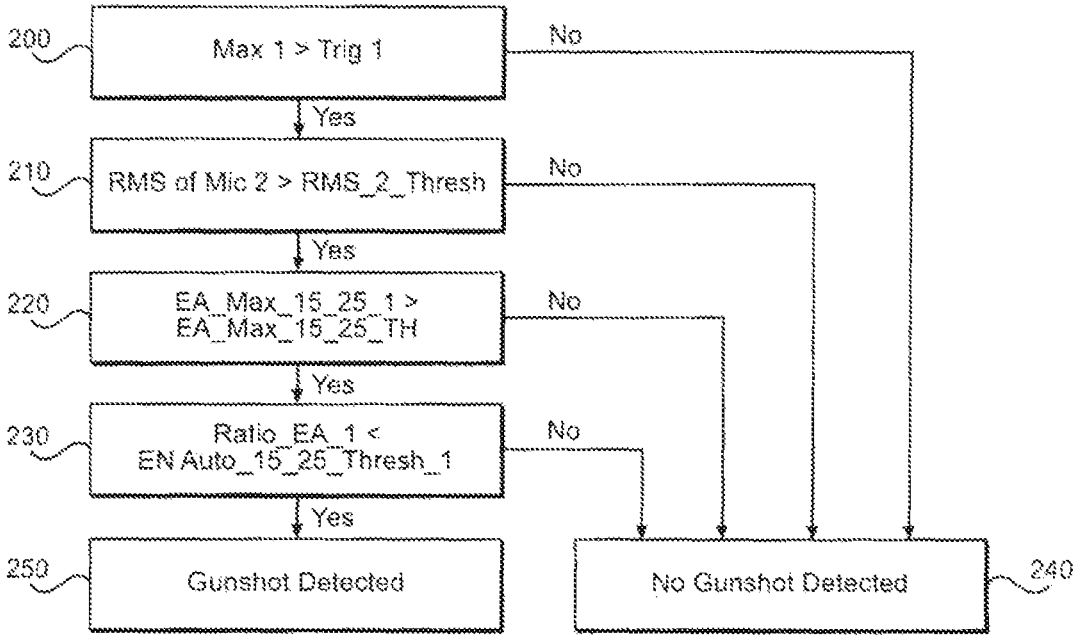
FIG. 3 is a flowchart of a comparing algorithm employed in accordance with the invention.

Once the calculations associated with the FIG. 2 algorithm are performed, it can then be determined if the detected sounds were actually from a gunshot. In accordance with a preferred embodiment of the invention as represented in FIG. 3, it is only determined that a gunshot has been detected if multiple requirements are satisfied, i.e., each of the requirements of steps 200, 210, 220 and 230 are satisfied. Specifically, to move past step 200, it must be determined that the maximum amplitude sensed by microphone 15 is greater than the trigger value (Max_1>Trig_1). Of course, this is just a verification step based on the requirements of step 60. In addition, RMS_Full_2>RMS_2_Thresh (step 210), EA_Max_15_25_1>EA_Max_15_25_TH (step 220), and Ratio_EA_1<EnAuto_15_25_Thresh_1 (step 230). If any one of these determinations cannot be made, it is determined that a gunshot has not been detected (step 240). On the other hand, if all of these verification steps are satisfied, step 250 is reached to verify that an actual gunshot has been sensed. If a gunshot is detected at 250, this is signaled via port 35 to a networked computer that can be used for alert purposes, such as alerting emergency personnel, such as building or local jurisdictional personnel) of the occurrence of the gunshot and, based on the particular sensor used in making the determination, the location of the gunshot.

Although described with reference to preferred embodiments of the invention, it should be readily understood that various changes and/or modifications can be made to the invention without departing from the spirit thereof. Overall, it has been found that employing two microphones with low and high sensitivities and making a detection decision based on at least certain threshold, root-mean-square (RMS), time window, and auto correlation frequency values, provides for very low false alarms or false positives while, at the same time, provides for high detection rates. In any event, the invention is only intended to be limited by the scope of the following claims.

The invention claimed is:

1. A method of acoustically detecting a gunshot comprising the steps of:

a) identifying when an incoming acoustic signal sensed with a first microphone, having a low sensitivity, has a peak amplitude level greater than a trigger threshold established for a potential gunshot;

b) if a potential gunshot is identified in step a), analyzing output signals sensed by the first microphone corresponding to the potential gunshot to establish operational and nominal threshold values for the first microphone and a second microphone which is more sensitive than the first microphone to determine a maximum amplitude, respectively, for the first microphone and the second microphone, and analyzing the output signals sensed by the first microphone in multiple, distinct frequency ranges to determine a ratio for summation values to enable gunshot false positive identification;

c) only if a potential gunshot is identified in step a), comparing a value calculated based on signals from the second microphone corresponding to the incoming acoustic signal, with a threshold value corresponding to a time after the output signals sensed by the first microphone window with respect to a specific time window, wherein the threshold value corresponds to the operational and nominal threshold value for the second microphone to determine sound dissipation of the incoming acoustic signal; and d) determining that an occurrence of a gunshot has been detected based on results from both steps b) and c).

2. The method of claim 1, further comprising: determining a time for the potential gunshot which is prior to a time when the incoming acoustic signal is sensed with the first microphone.

3. The method of claim 2, further comprising: basing the time for the potential gunshot based on amplitudes of signals from the first microphone at multiple, different times.

4. The method of claim 1, further comprising: performing enhanced autocorrelation on signals from the first microphone.

5. The method of claim 4, further comprising: calculating a maximum of the enhanced autocorrelation within a defined frequency range.

6. The method of claim 5, wherein the defined frequency range is between 15 kHz and 25 kHz.

7. The method of claim 1, wherein analyzing signals sensed by the first microphone in multiple, distinct frequency ranges includes calculating a sum of amplitudes in a first frequency range.

8. The method of claim 7, wherein the first frequency range is from 10 kHz to 25 kHz.

9. The method of claim 7, wherein analyzing signals sensed by the first microphone in multiple, distinct frequency ranges further includes calculating a sum of amplitudes in a second frequency range which is lower than the first frequency range.

10. The method of claim 9, wherein the second frequency range is from 2 kHz to 5.5 kHz.

11. The method of claim 10, wherein analyzing signals sensed by the first microphone in multiple, distinct frequency ranges further includes calculating a ratio of the sum of amplitudes in the first and second frequency ranges.

12. The method of claim 1, wherein comparing a value calculated based on signals from a second microphone includes determining a root-mean-square value of signals from the second microphone over a predetermined time period and comparing the root-mean-square value with the threshold value.

13. The method of claim 1, wherein the method is limited to determining the occurrence of a gunshot within a building or other structure.

14. The method of claim 1, further comprising: alerting emergency personnel when the occurrence of a gunshot has been detected.

15. The method of claim 1, wherein the first microphone has a sensitivity of below −40 dBFS.

16. The method of claim 1, wherein the second microphone has a sensitivity that is at least 70% greater than the sensitivity of the first microphone.

17. The method of claim 1, wherein only outputs from the first microphone are initially, continuously analyzed for a peak amplitude level greater than the trigger threshold.

18. A system for acoustically detecting a gunshot within a building or other structure comprising:

a sensor including a first microphone having a low sensitivity and a second microphone which is more sensitive than the first microphone; and a controller configured to determine an occurrence of a gunshot within the building or other structure based on signals received from each of the first and second microphones, wherein only if a potential gunshot is identified with the first microphone are signals analyzed from the second microphone;

wherein the controller analyzes output signals sensed by the first microphone corresponding to the potential gunshot to establish operational and nominal threshold values for the first microphone and a second microphone which is more sensitive than the first microphone to determine a maximum amplitude, respectively, for the first microphone and the second microphone, and analyzing the output signals sensed by the first microphone in multiple, distinct frequency ranges, and the controller determines a ratio for summation values to enable gunshot false positive identification, and only if a potential gunshot is identified, the controller then compares a value calculated based on signals from the second microphone corresponding to the incoming acoustic signal, with a threshold value corresponding to a time after the output signals sensed by the first microphone window with respect to a specific time window, and wherein the threshold value corresponds to the operational and nominal threshold value for the second microphone to determine sound dissipation of the incoming acoustic signal.

19. The system of claim 18, wherein the sensor further includes a network port configured to connect the sensor to a remote computer.

20. The system of claim 18, wherein the first and second microphones are MEMS microphones.

* * * * *